US011761593B2

(12) United States Patent
Wagner et al.

(10) Patent No.: US 11,761,593 B2
(45) Date of Patent: Sep. 19, 2023

(54) PORTABLE LIGHTING APPARATUS

(71) Applicant: TECHTRONIC CORDLESS GP, Anderson, SC (US)

(72) Inventors: Jacob Wagner, Greenville, SC (US); Jamie Canavan, Greenville, SC (US); Ryan Altenburger, Greenville, SC (US); Daniel Meling, Greenville, SC (US); Patrick Brown, Greenville, SC (US); Matt Mandel, Easley, SC (US); Brianna E. Williams, Mauldin, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 17/849,407

(22) Filed: Jun. 24, 2022

(65) Prior Publication Data

US 2023/0084530 A1 Mar. 16, 2023

Related U.S. Application Data

(60) Provisional application No. 63/243,498, filed on Sep. 13, 2021.

(51) Int. Cl.
*F21L 4/02* (2006.01)
*F21V 21/30* (2006.01)
(Continued)

(52) U.S. Cl.
CPC ..... *F21L 4/027* (2013.01); *F21L 4/025* (2013.01); *F21L 4/04* (2013.01); *F21L 4/045* (2013.01);
(Continued)

(58) Field of Classification Search
CPC ... F21L 4/04; F21L 4/045; F21L 4/025; F21V 23/002; F21V 21/30; F21V 21/145
See application file for complete search history.

(56) References Cited

U.S. PATENT DOCUMENTS 1,699,927 A 1/1929 Stearns
2,381,510 A 8/1945 Muldoon
(Continued)

FOREIGN PATENT DOCUMENTS

CN 208058486 U 11/2018
CN 208475007 U 2/2019
(Continued)

*Primary Examiner* — William N Harris
(74) *Attorney, Agent, or Firm* — Michael Best & Friedrich LLP

(57) ABSTRACT

A portable lighting apparatus includes a handle, a light head pivotally coupled to the handle through a plurality of positions via a joint, a battery receptacle supported by the handle, a first light source supported in the light head, a second light source supported in the light head, and a user interface supported by the handle and configured to be selectively actuated by a user to operate the first light source and the second light source. The battery receptacle is configured to receive a rechargeable battery. The first light source includes a laser selectively operable to emit a single light wavelength, and the second light source includes one or more LEDs selectively operable to emit a distribution of light wavelengths.

16 Claims, 9 Drawing Sheets

(51) Int. Cl.

| | |
|---|---|
| ***F21L 4/04*** | (2006.01) |
| ***F21V 21/14*** | (2006.01) |
| ***F21V 21/096*** | (2006.01) |
| ***F21V 23/00*** | (2015.01) |
| ***F21Y 115/10*** | (2016.01) |
| ***F21Y 113/20*** | (2016.01) |
| ***F21Y 115/30*** | (2016.01) |

(52) U.S. Cl.

CPC ..... *F21V 21/0965* (2013.01); *F21V 21/145* (2013.01); *F21V 21/30* (2013.01); *F21V 23/002* (2013.01); *F21Y 2113/20* (2016.08); *F21Y 2115/10* (2016.08); *F21Y 2115/30* (2016.08)

(56) References Cited

U.S. PATENT DOCUMENTS

| | | | | |
|---|---|---|---|---|
| 2,401,366 | A | 6/1946 | Muldoon | |
| 5,541,822 | A | 7/1996 | Bamber | |
| 5,871,272 | A | 2/1999 | Sharrah et al. | |
| 6,012,824 | A | 1/2000 | Sharrah et al. | |
| 6,022,127 | A | 2/2000 | Krietzman | |
| 6,250,771 | B1 | 6/2001 | Sharrah et al. | |
| 6,523,972 | B2 | 2/2003 | Sharrah et al. | |
| 6,585,391 | B1 | 7/2003 | Koch et al. | |
| 6,623,139 | B1 | 9/2003 | Gutmann | |
| 6,623,140 | B2 | 9/2003 | Watterson et al. | |
| 6,659,621 | B2 | 12/2003 | Sharrah et al. | |
| 6,802,623 | B1 | 10/2004 | Hsu et al. | |
| 6,817,730 | B2 | 11/2004 | Sharrah et al. | |
| 7,093,954 | B2 | 8/2006 | Sharrah et al. | |
| 7,125,140 | B2 | 10/2006 | Koch et al. | |
| D536,464 | S | 2/2007 | Kingston et al. | |
| 7,188,978 | B2 | 3/2007 | Sharrah et al. | |
| D548,385 | S | 8/2007 | Sharrah et al. | |
| 7,281,815 | B1 | 10/2007 | Gustafson et al. | |
| 7,314,286 | B2 | 1/2008 | Sharrah et al. | |
| 7,334,915 | B2 | 2/2008 | Kim | |
| 7,534,975 | B1 | 5/2009 | Sharrah et al. | |
| 7,549,766 | B2 | 6/2009 | Sharrah et al. | |
| 7,566,149 | B2 | 7/2009 | Koch et al. | |
| 7,614,760 | B2 | 11/2009 | Sharrah et al. | |
| 7,699,491 | B2 | 4/2010 | Sharrah et al. | |
| 7,731,385 | B2 | 6/2010 | Spartano et al. | |
| 7,802,898 | B1 | 9/2010 | Gregory et al. | |
| 7,850,329 | B2 | 12/2010 | Henry et al. | |
| 7,850,330 | B2 | 12/2010 | Spartano et al. | |
| 7,896,518 | B2 | 3/2011 | Holmes et al. | |
| 7,959,317 | B2 | 6/2011 | Spartano et al. | |
| 8,025,420 | B2 | 9/2011 | Henry et al. | |
| 8,033,680 | B2 | 10/2011 | Sharrah et al. | |
| 8,052,297 | B2 | 11/2011 | Gross et al. | |
| 8,210,710 | B2 | 7/2012 | Koch et al. | |
| 8,226,267 | B2 | 7/2012 | Sharrah et al. | |
| 8,240,874 | B2 | 8/2012 | Koch et al. | |
| 8,297,775 | B2 * | 10/2012 | Wright | H05B 47/17 315/312 |
| 8,348,454 | B2 | 1/2013 | Henry et al. | |
| 8,371,729 | B2 | 2/2013 | Sharrah et al. | |
| 8,376,574 | B2 | 2/2013 | Spartano et al. | |
| 8,395,066 | B2 | 3/2013 | Koch et al. | |
| 8,469,540 | B1 | 6/2013 | Gregory et al. | |
| 8,507,819 | B2 | 8/2013 | Steinicke et al. | |
| 8,641,226 | B2 | 2/2014 | Yeh | |
| 8,783,908 | B2 | 7/2014 | Gross et al. | |
| 8,960,949 | B2 | 2/2015 | Koch et al. | |
| 9,217,558 | B2 | 12/2015 | Sparing et al. | |
| 9,267,758 | B2 | 2/2016 | Risicato | |
| D765,295 | S | 8/2016 | McLennan | |
| 9,587,671 | B2 | 3/2017 | Bao | |
| 9,719,669 | B2 | 8/2017 | Koch et al. | |
| 9,964,290 | B2 | 5/2018 | Sharrah et al. | |
| 10,018,342 | B2 | 7/2018 | Koch et al. | |
| 10,119,663 | B2 | 11/2018 | Bayat et al. | |
| 10,344,959 | B2 | 7/2019 | Worman et al. | |
| 10,378,702 | B2 | 8/2019 | Sharrah et al. | |
| 10,612,761 | B1 | 4/2020 | Worman et al. | |
| 10,663,146 | B2 | 5/2020 | Stevenson et al. | |
| 10,697,623 | B2 | 6/2020 | Worman et al. | |
| 10,837,609 | B2 | 11/2020 | Sharrah et al. | |
| D907,825 | S | 1/2021 | McLennan | |
| 10,948,139 | B2 | 3/2021 | McLennan | |
| 11,162,649 | B1 | 11/2021 | Sharrah et al. | |
| D940,369 | S | 1/2022 | McLennan | |
| 2009/0284186 | A1 | 11/2009 | Koch et al. | |
| 2010/0046211 | A1 * | 2/2010 | Spartano | F21L 4/045 362/157 |
| 2010/0225246 | A1 | 9/2010 | Spartano et al. | |
| 2010/0231142 | A1 | 9/2010 | Yoon | |
| 2011/0149562 | A1 | 6/2011 | Spartano et al. | |
| 2013/0148367 | A1 | 6/2013 | Sharrah et al. | |
| 2013/0335996 | A1 | 12/2013 | Yao et al. | |
| 2014/0268703 | A1 * | 9/2014 | Ehlert | F21L 4/027 362/208 |
| 2015/0247628 | A1 | 9/2015 | Li | |
| 2015/0308668 | A1 | 10/2015 | Koch et al. | |
| 2016/0018071 | A1 | 1/2016 | Sharrah et al. | |
| 2017/0284646 | A1 * | 10/2017 | Arena | F21L 4/02 |
| 2017/0292659 | A1 * | 10/2017 | Bayat | F21L 4/045 |
| 2017/0307148 | A1 * | 10/2017 | Sharrah | F21L 4/045 |
| 2018/0299109 | A1 | 10/2018 | Koch et al. | |
| 2019/0331306 | A1 * | 10/2019 | Westling | F21V 5/006 |

FOREIGN PATENT DOCUMENTS

| | | | |
|---|---|---|---|
| CN | 214306606 | U | 9/2021 |
| WO | 03074232 | A2 | 9/2003 |
| WO | 2007012570 | A1 | 2/2007 |

* cited by examiner

PORTABLE LIGHTING APPARATUS

CROSS-REFERENCE TO RELATED APPLICATIONS

This application claims priority to U.S. Provisional Patent Application No. 63/243,498, filed Sep. 13, 2021, the entire contents of which are incorporated herein by reference.

FIELD

The present disclosure relates to a lighting apparatus, such as a handheld flashlight or portable lighting assembly. More particularly, the present disclosure relates to a flashlight with multiple light sources and modes, including a laser and laser mode.

BACKGROUND

Flashlights are used to illuminate dark areas. Some flashlights may include multiple light sources that are selectively useable based on a desired application of the flashlight. Such flashlights often include a body that houses a battery and a light head coupled to the body.

SUMMARY

One embodiment of the disclosure provides a portable lighting apparatus including a handle; a light head pivotally coupled to the handle through a plurality of positions via a joint; a battery receptacle supported by the handle, the battery receptacle configured to receive a rechargeable battery; a first light source supported in the light head, the first light source including a laser selectively operable to emit a single light wavelength; a second light source supported in the light head, the second light source including one or more LEDs selectively operable to emit a distribution of light wavelengths; and a user interface supported by the handle and configured to be selectively actuated by a user to operate the first light source and the second light source.

In another embodiment, the disclosure provides a portable lighting apparatus including a first light source selectively operable to emit a first type of light; a second light source selectively operable to emit a second type of light different from the first type of light, the first light source and the second light source operable to emit their respective types of light simultaneously with and independently of one another; and a user interface configured to be selectively actuated by a user to operate the first light source and the second light source, the user interface including a single actuatable member, wherein actuating the user interface for a first duration controls the first light source, and wherein actuating the user interface for a second duration that is different than the first duration controls the second light source.

Another embodiment of the disclosure provides a portable lighting apparatus including a handle including a first end and a second end; a light head pivotally coupled to the handle adjacent the first end; a battery receptacle supported by the handle adjacent the second end, the battery receptacle configured to receive a rechargeable battery; a detent positioned between the handle and the light head, the detent being biased into engagement with the handle or the light head to resist pivoting movement of the light head relative to the handle; a first light source supported in the light head, the first light source selectively operable to emit a first type of light; a second light source supported in the light head, the second light source selectively operable to emit a second type of light, the first light source and the second light source operable to emit their respective types of light simultaneously with and independently of one another; and a button selectively actuated by a user to operate both the first light source and the second light source.

Other aspects of the disclosure will become apparent by consideration of the detailed description and accompanying drawings.

Figure 1:
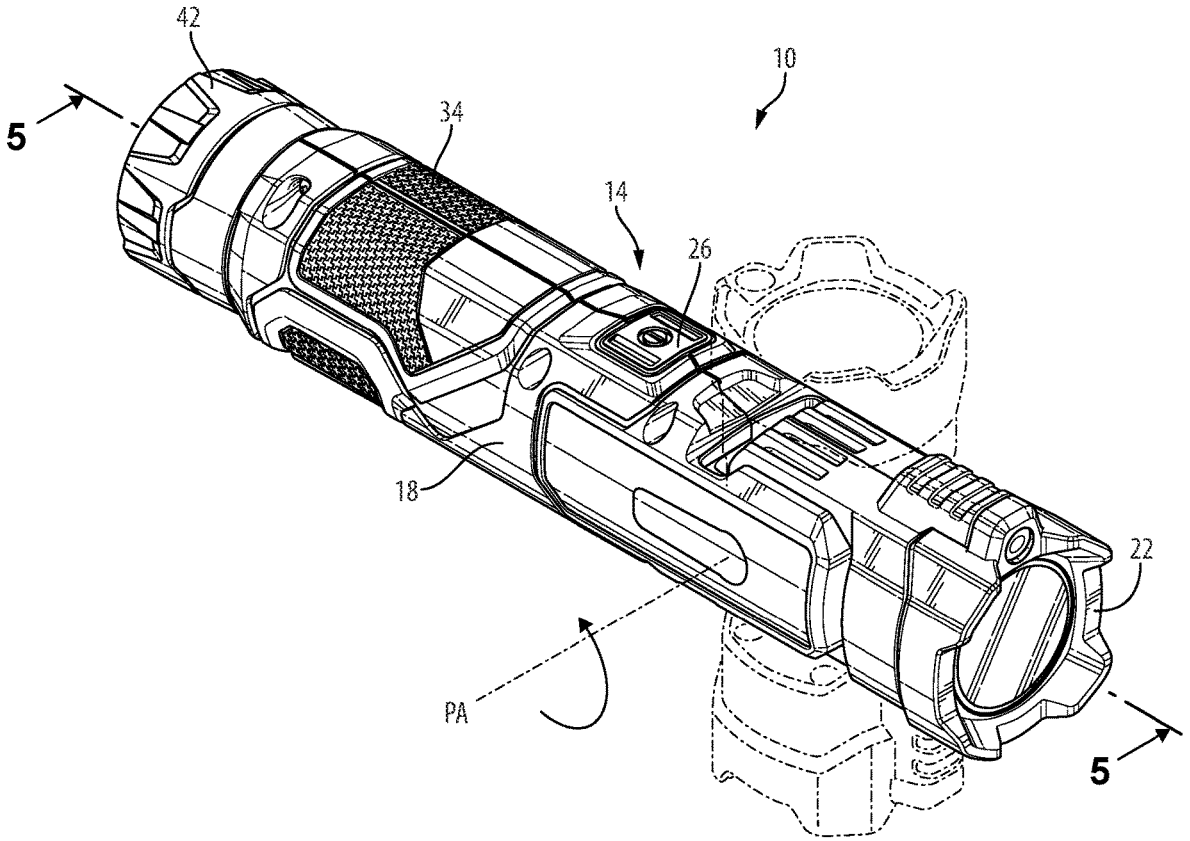
FIG. 1 is a perspective view of a flashlight, according to one embodiment, illustrating a pivoting light head in a first solid position, and illustrating example phantom positions of the light head.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

Features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

Terms of approximation, such as "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

DETAILED DESCRIPTION

FIG. 1 illustrates a portable lighting apparatus, such as a flashlight 10. In other embodiments, the lighting apparatus may be other types of devices, such as a headlamp, a work light, a flood light, an area light, or the like. The illustrated flashlight 10 includes a housing 14 and is operable in multiple modes (e.g., different levels of brightness). The housing 14 includes a handle 18, a light head 22, and a user interface 26. The user interface 26 is operable to turn the flashlight 10 ON and OFF. The user interface 26 is also operable to change an operating mode of the flashlight 10. The user interface 26 is further operable to selectively energize a first light source 27 (FIG. 5) suitable to emit a first type of light, such as a pointed light (e.g., laser, beamed light, etc.) and a second light source 28 (FIG. 5) suitable to emit a second, different, type of light, such as an area light (e.g., light emitting diode or "LED," spread light, etc.). Stated another way, the first light source 27 is selectively operable to emit a single light wavelength, while the second light source 28 is selectively operable to emit a distribution of light wavelengths. In the illustrated embodiment, the first light source 27 and the second light source 28 are positioned to direct light in a substantially common direction but could be positioned differently/adjustably on the light head 22 and/or handle 18 to direct light in other directions.

The illustrated user interface 26 is a pressable pad or button (e.g., push-button), but other types of selectors, such as a rotatable ring, slider, or the like, are contemplated. A portion of the user interface 26 may include an indicator to display a charge/battery status (e.g., green for full battery, yellow for partial battery, red for low battery, etc.) of the flashlight 10. As illustrated in FIG. 1, the user interface 26 is supported on the handle 18 and positioned to be easily pressable by a thumb of a user. In other embodiments, the user interface 26 could alternatively be positioned another part of the flashlight 10. As described in greater detail below, the user interface 26 may be operable (e.g., by a user) to control the first light source 27 and the second light source 28 to emit their respective types of light simultaneously with and independently of one another. For example, a user may point at an object with the first light source 27 while illuminating an area around the pointed light with the second light source 28. Such a scenario would be simultaneous use of the first light source 27 and the second light source 28. The first light source 27 may also be turned ON when the second light source 28 is OFF, or vise versa. Such a scenario would be independent use of the first light source 27 and the second light source 28.

Figure 2:
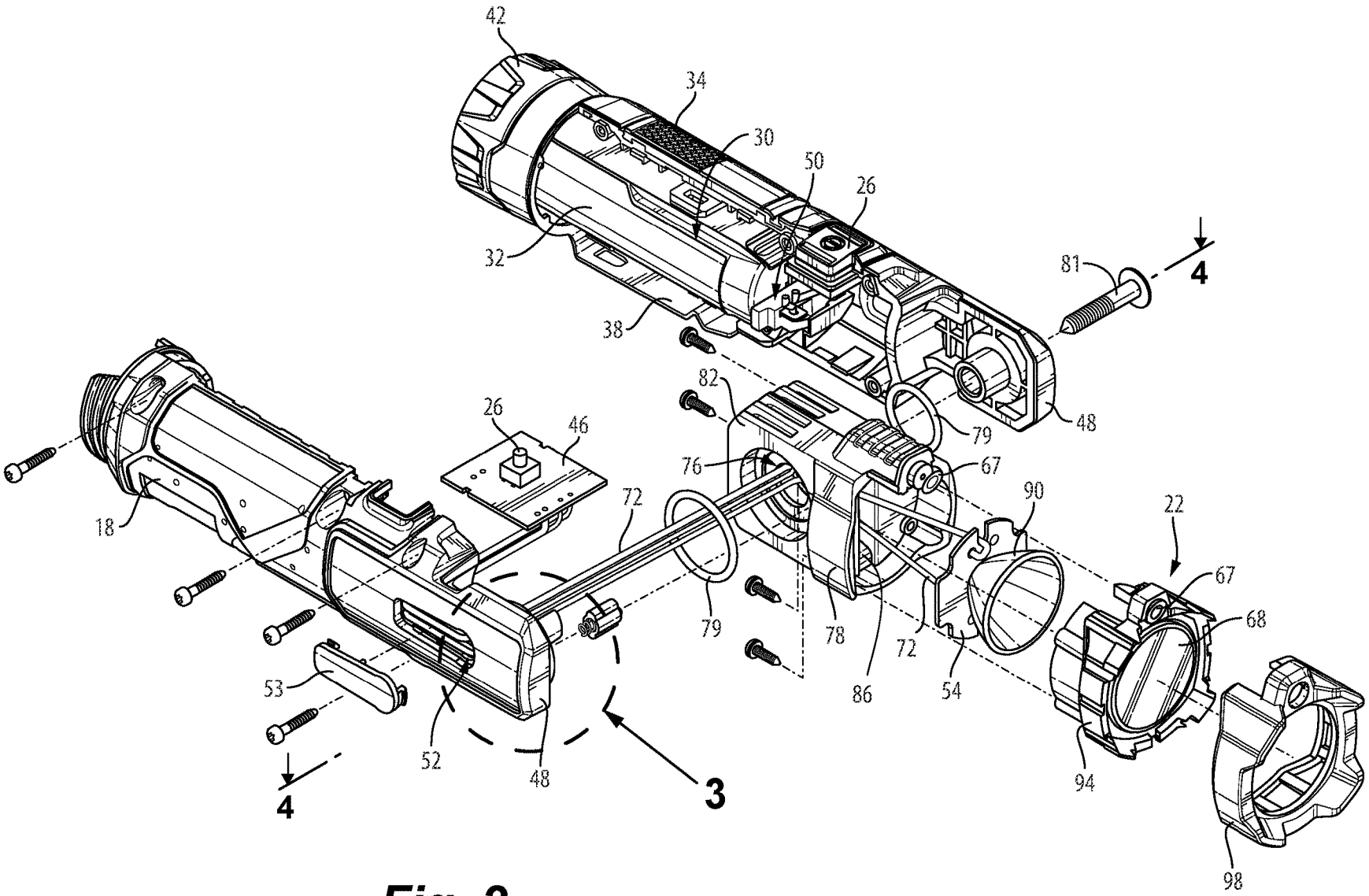
FIG. 2 is a partially exploded perspective view of the flashlight of FIG. 1.
Figure 3:
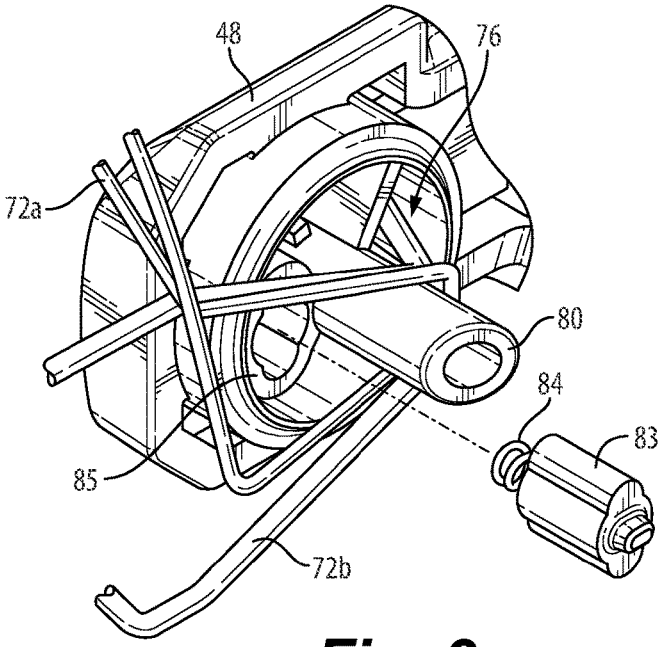
FIG. 3 is a magnified view, illustrating the isolated callout shown in FIG. 2, and illustrating a detent mechanism.

With reference to FIGS. 1 and 2, the handle 18 supports a battery receptacle 30 and a battery 32, such as a removable and/or rechargeable battery, received in the battery receptacle 30. The battery 32 may include one or more batteries, such as Li-ion batteries or alkaline batteries. In some examples, the battery 32 includes other power storage devices, such as super-capacitors or ultra-capacitors. In some embodiments, the battery 32 includes combinations of active and passive components (e.g., voltage step-down controllers, voltage converters, rectifiers, filters, etc.).

The battery 32 is selectively concealed in the handle 18 and powers the flashlight 10. The illustrated handle 18 also includes a grip 34, a clip 38, and a tail cap 42. The grip 34 may be defined by, for example, a knurled or otherwise contoured surface. The tail cap 42 is removable from a remainder of the handle 18 to access the battery 32 within the battery receptacle 30. In the illustrated embodiment, the tail cap 42 is threaded onto the remainder of the handle 18. The handle 18 and/or housing 14 may include opposing halves that can be fastened together via fasteners, a snap-connection, adhesive, or the like. In some instances, elements, such as the user interface 26, may be positioned between the halves before the are fastened together. The tail cap 42 may also be threaded around the fastened halves.

Figure 5:
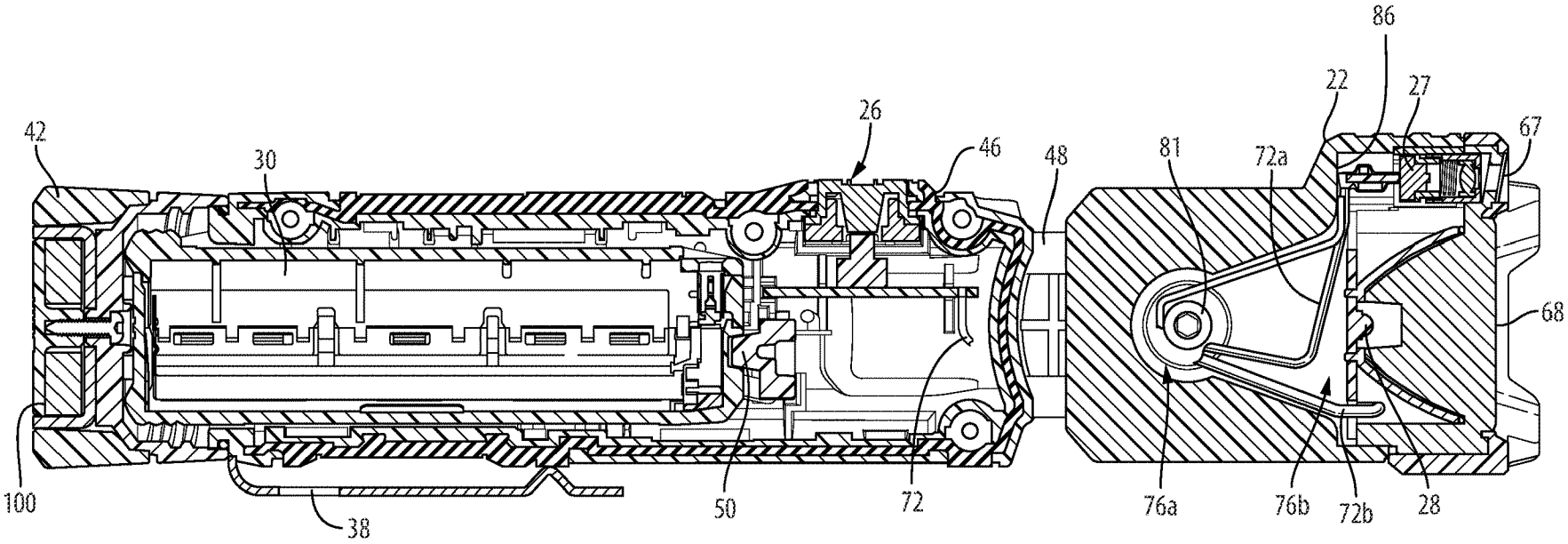
FIG. 5 is a cross-sectional view of the flashlight of FIG. 1, taken through section like 5-5 in FIG. 1.

As illustrated in FIGS. 2 and 5, the handle 18 supports the user interface 26 and houses a main control board or "MCB" 46, a joint fork 48 positioned adjacent a first end of the handle 18, the battery receptacle 30 positioned adjacent a second end of the handle 18, and a wiring channel 52 positioned adjacent the joint fork 48. The battery receptacle 30 may also support power terminals 50 in electrical communication with the battery 32 and the MCB 46.

The light head 22 supports a light board 54, the first light source 27, a first lens 67, the second light source 28, and a second lens 68. In the illustrated embodiment, the first light source 27 is in electrical communication with the MCB 46 via wiring 72, and the second light source 28 is in electrical communication with the light board 54 via wiring 72, which is further in electrical communication with the MCB 46 via wiring 72. In some embodiments, the second light source 28 may include an array of LEDs. In other embodiments, the light head 22 may include other suitable light sources. It should also be noted that the electrical components (e.g., MCB 46, first light source 27, etc.) may be in direct electrical communication (e.g., contact without requiring separate wiring).

Figure 4:
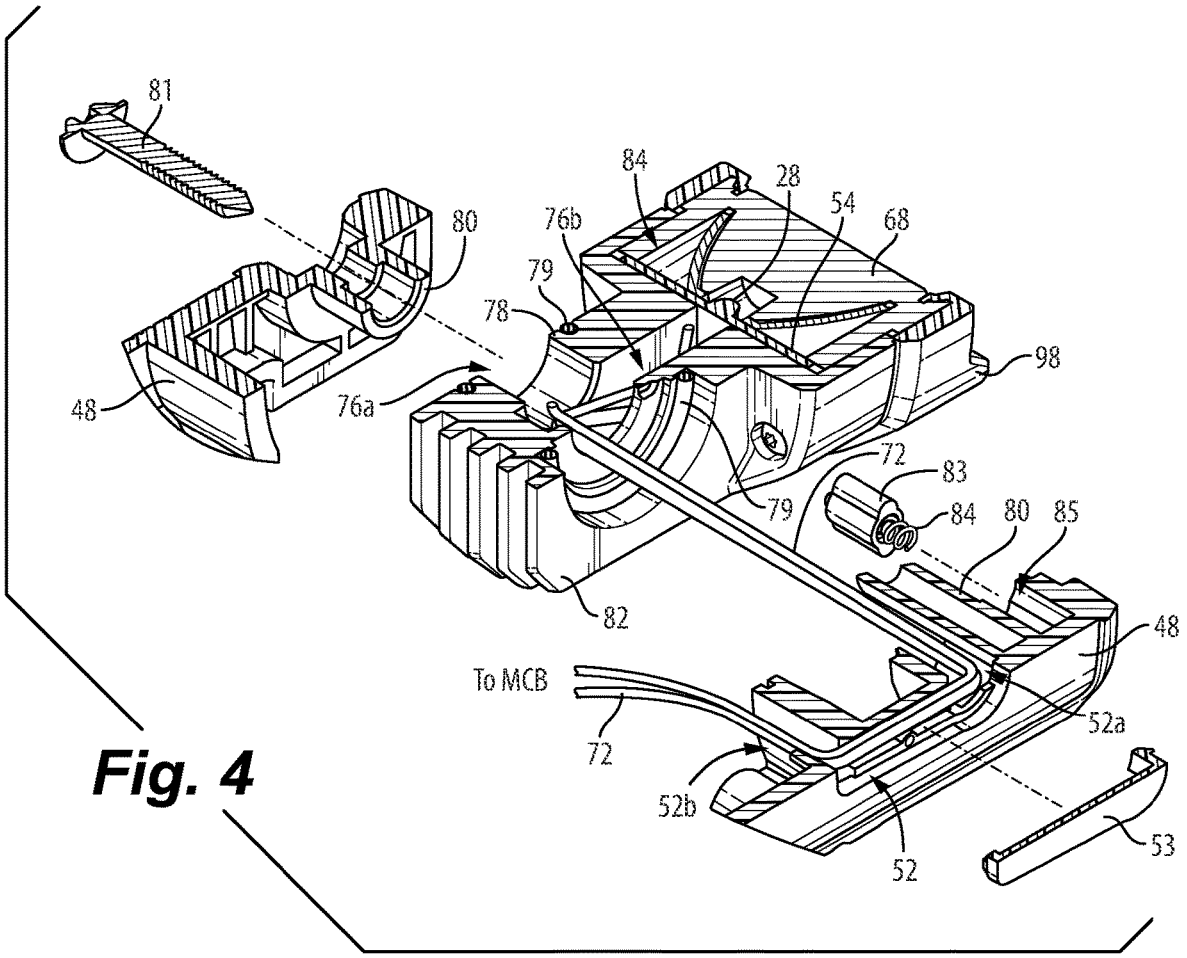
FIG. 4 is an exploded cross-sectional perspective view of a portion of the flashlight of FIG. 1, taken through section line 4-4 in FIG. 2.

With reference to FIGS. 2 and 4, the wiring channel 52 may be selectively covered by a cap or cover 53 to hide the wiring 72 post-fabrication (e.g., before sale of the flashlight 10). In the illustrated embodiment, the cover 53 may be irremovably snapped over the wiring channel 52 once the wiring 72 has been completely routed through desired portions of the flashlight 10. The wiring channel 52 may also include a through-hole 52*a* extending from within the joint fork 48 to an outer surface of the joint fork 48/handle 18 and an opening 52*b* extending between the wiring channel 52 and an interior of the handle 18, such that the wiring 72 may be routed through the joint fork 48 and into the through-hole 52*a*, along the wiring channel 52, and through the opening 52*b* to the interior of the handle 18.

With reference to FIGS. 2-5, the light head 22 further includes an opening 76 that is formed in a base portion 78 of the light head 22 and is configured to receive the wiring 72 from the handle 18. The opening 76 may include a cylindrical portion 76*a* and a slit portion 76*b*. As best shown in FIG. 4, the cylindrical portion 76*a* receives complementary stems 80 oppositely formed on halves of the joint fork 48. The cylindrical portion 76*a* may support bushings, bearings, and/or the like, as well as seals or gaskets, such as an O-ring 79, on either side of the opening 76. In general, the stems 80 extend from the joint fork 48 through the opening 76 to form a pivoting joint between the handle 18 and the light head 22, such that the light head 22 may be pivoted relative to the handle 18 about a pivot axis PA (FIG. 1).

An O-ring 79 may be positioned between the handle 18 making up the joint fork 48 and the base portion 78 or the light head 22. The stems 80 may be inserted into opposing sides of the opening 76, and the wiring 72 may be routed adjacent the stems 80 to be generally positioned between the stems 80 and walls of the opening 76. The wiring 72 may then be routed through the cylindrical portion 76*a*, through the slit portion 76*b*, and to the first light source 27 and the second light source 28. The base portion 78 may include a heat sink 82. In the illustrated embodiment, the light head 22 and handle 18 are pivotally connected by a joint fastener 81 extending through the stems 80 and indirectly within the opening 76. In the illustrated embodiment, the joint fastener 81 is a threaded fastener, such as a screw or bolt. In other embodiments, the joint fastener 81 may be another type of fastener, such as a rivet.

As best shown in FIG. 5, the slit portion 76*b* increases in size (e.g., expands) between the cylindrical portion 76*a* and a seat 86 formed by an end of the light head 22. The seat 86 supports the light board 54, which may alternatively/additionally be a conductive substrate. The light board 54 generally supports the second light source 28 and a reflector cup or bowl 90 surrounding the second light source 28. As also shown in FIG. 2, the second light source 28 and bowl 90 may be held in the seat 86 by a holder 94 received on the light head 22, which may then be set in the light head 22 by a retainer 98 positioned over the holder 94 and coupled to the base portion 78.

The flashlight 10 may further include one or more magnets 100 configured to magnetically support the flashlight 10 on a magnetic member (e.g., ferric, metallic, etc.). In the illustrated embodiment, magnets 100 are supported in the tail cap 42 to suitably support the flashlight 10. The magnets 100 may alternatively/additionally be positioned in other parts of the flashlight 10, such as in the handle 18, the light head 22, and the like.

As further shown in FIG. 5, the wiring 72 extends from the MCB 46, through the wiring channel 52 (not shown, behind line 5-5), and into the opening 76. The wiring 72 includes laser wiring 72*a* extending to the first light source 27 and LED wiring 72*b* extending to the second light source 28.

With reference to FIGS. 3-4 and 6-11, a detent 83 may be positioned between the handle 18 and the light head 22. In the illustrated embodiment, the detent 83 is positioned adjacent the joint. The detent 83 may be biased into engagement with the handle 18 and/or the light head 22, via a biasing member, such as a spring 84, to resist pivoting movement of the light head 22 relative to the handle 18. More specifically, the detent 83 may be positioned adjacent the joint fork 48, the stems 80, and the opening 76. A sleeve 85 in either/both of the light head 22 and the handle 18 may partially isolate the detent 83, such that the wiring 72 may be inhibited from impeding movement of the detent 83.

The other of the light head 22 and the handle 18 (e.g., opposite the sleeve 85) may include an indent 102 that receives the detent 83. The indent 102 may have ramped edges 106 (FIG. 9) that provide a slip-type connection between the detent 83 and the indent 102. The ramped edges 106 may resist removal of the detent 83 from the indent 102 by providing a holding force that is slightly greater than a biasing force provided by the spring 84. During selective rotation/pivoting of the light head 22, the added force provided by slipping of the detent 83 against the ramped edges 106 provides enough added force to overcome the biasing force and move the detent 83 from the indent 102, thereby allowing pivoting of the light head 22 relative to the handle 18.

Figure 6:
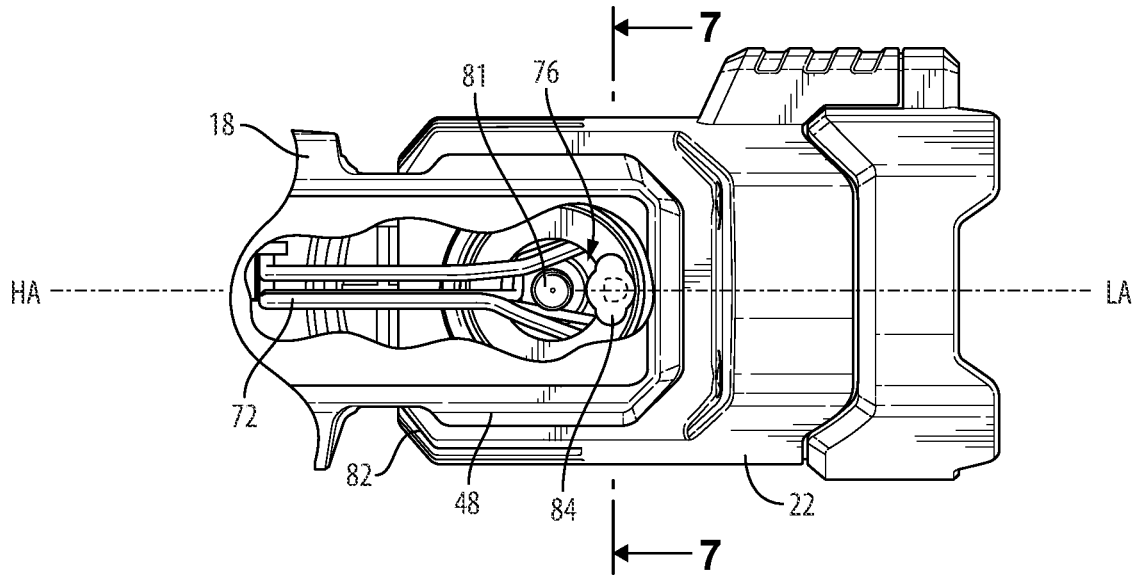
FIG. 6 is a side perspective view of the flashlight of FIG. 1, illustrating the light head in a generally horizontal position with a portion of the flashlight cut away to reveal wiring to the light head.
Figure 7:
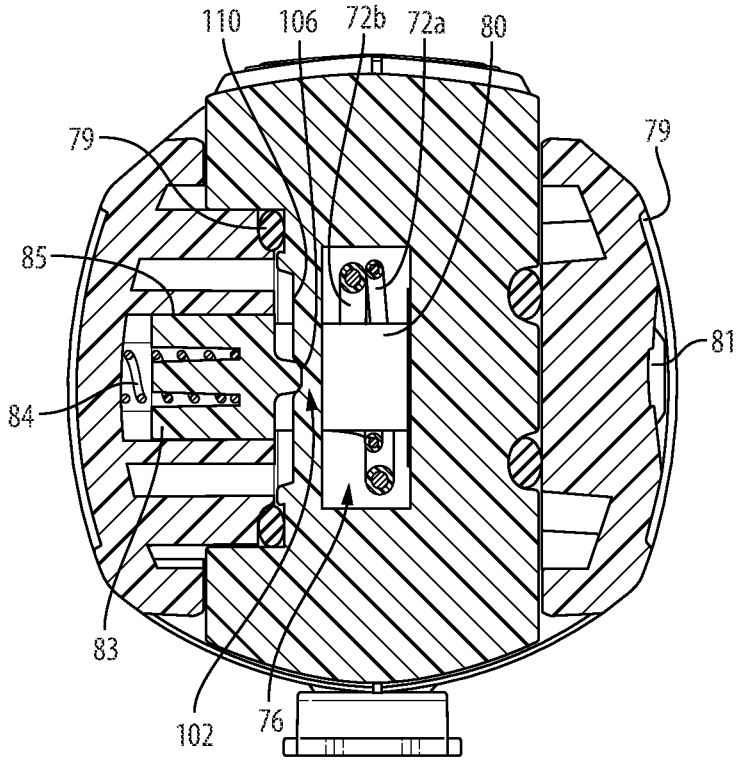
FIG. 7 is a cross-sectional front view of the flashlight of FIG. 1, taken through section line 7-7 in FIG. 6, illustrating the light head in the generally horizontal position.
Figure 8:
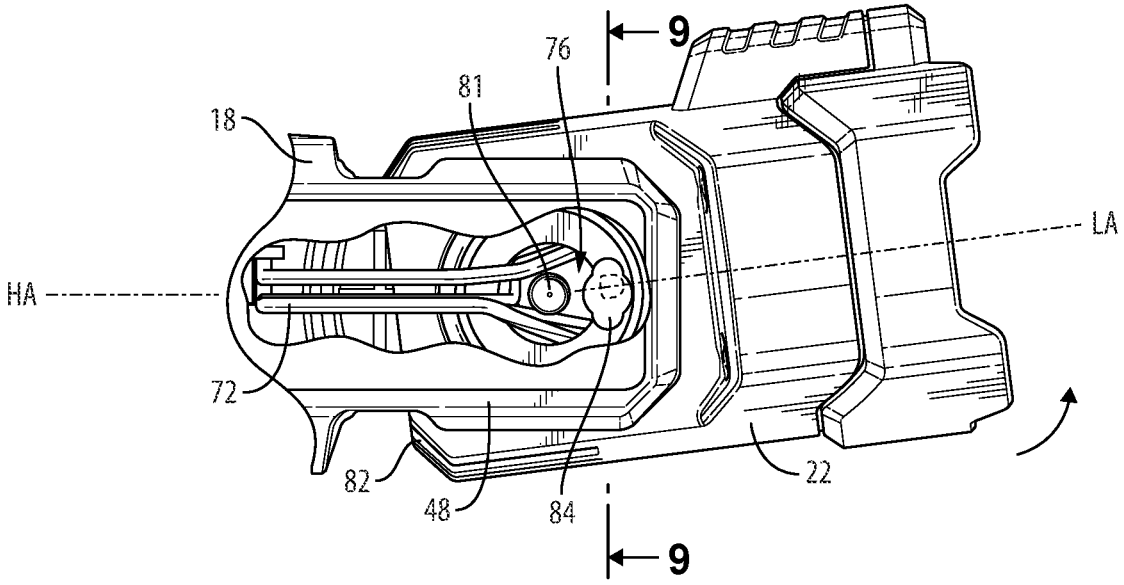
FIG. 8 is another side perspective view of the flashlight of FIG. 1, similar to FIG. 6, illustrating the light head in an angled position.
Figure 9:
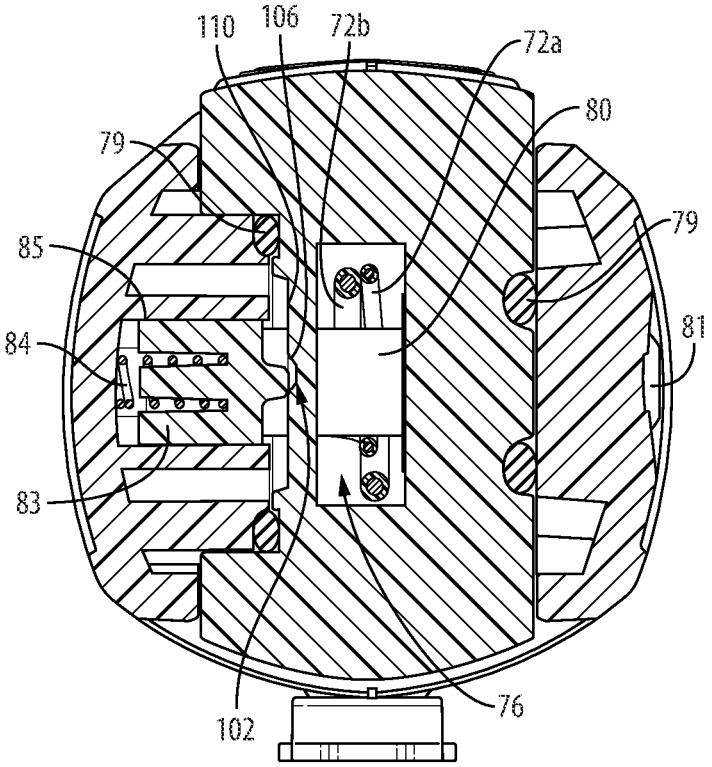
FIG. 9 is a cross-sectional front view of the flashlight of FIG. 1, taken through section line 9-9 in FIG. 8, illustrating the light head in the angled position.

As illustrated in FIG. 6, the light head 22 may be held in a generally flat or horizontal position relative to the handle 18 (e.g., common orientation). In the common orientation, a light head axis LA of the light head 22 is generally aligned with a handle axis HA of the handle 18, and the detent 83 is pressed into the indent 102 to resist misalignment of the light head axis LA and the handle axis HA.

Referring now to FIGS. 8-11, as described above, the detent 83 may be forced against the ramped edges 106 by a user pivoting the light head 22 relative to the handle 18, which slips the detent 83 out of the indent 102 and against a flat surface 110 of the light head 22. The detent 83 may then press on the flat surface 110 as the light head 22 is pivoted through a plurality of angled positions until the detent 83 is met by the same or another indent 102. As specifically illustrated in FIGS. 8 and 9, the light head 22 may be held in a generally misaligned or offset position relative to the handle 18 (e.g., angled orientation). In the angled orientation, the light head axis LA is generally angled relative to the handle axis HA, and the detent 83 is pressed onto the flat surface 110 the indent 102 to allow angular adjustment of the light head axis LA relative to the handle axis HA.

While only a single indent 102 is illustrated for the flashlight in the common orientation (FIGS. 6 and 7), the light head 22 and/or handle 18 may include multiple indents 102 arranged about the opening 76 to provide multiple predetermined positions/orientation of the light head 22 and handle 18. For example, two total indents 102 may be provided and offset by approximately 165 degrees to 205 degrees (e.g., approximately 180 degrees). In another embodiment, three total indents 102 may be provided and offset by approximately 110 degrees to 160 degrees (e.g., approximately 120 degrees). In another embodiment, four or more total indents 102 may be provided and offset by approximately 45 degrees to 110 degrees (e.g., approximately 90 degrees).

Figure 10:
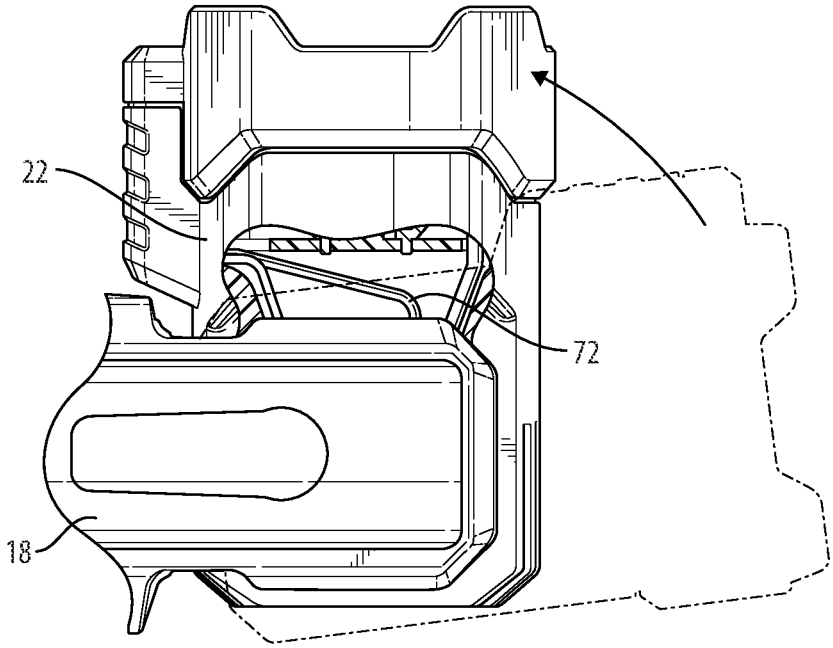
FIG. 10 is a side perspective view of the flashlight of FIG. 1, illustrating the light head in an angled upward position, with a portion of the flashlight cut away to reveal wiring to the light head.
Figure 11:
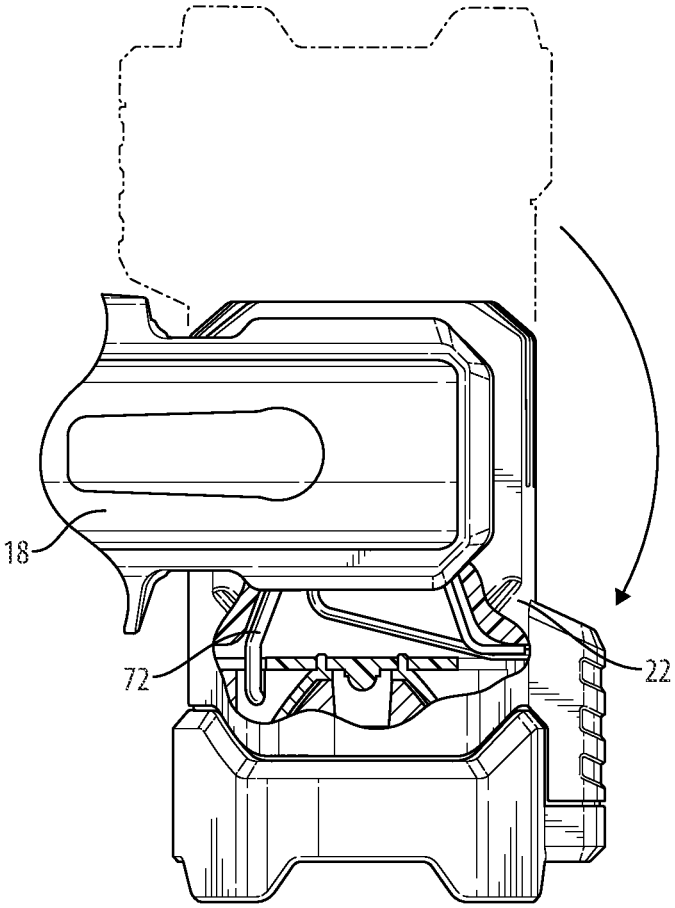
FIG. 11 is another side perspective view of the flashlight of FIG. 1, similar to FIG. 10, illustrating the light head in an angled downward position.

FIG. 10 illustrates the light head 22 pivoted relative to the handle 18 into and held in a generally straight-up orientation (e.g., plus (+) approximately 90 degrees from the common orientation), and FIG. 11 illustrates the light head 22 pivoted relative to the handle 18 into and held in a generally straight-down orientation (e.g., minus (−) approximately 90 degrees from the common orientation). The light head 22 may be pivoted into and held, via the detent 83 and indent(s) 102, in positions from the generally straight-down orientation to the generally straight-up orientation, depending on a desired embodiment of the flashlight 10.

It should be understood than any number of indents 102 may be provided to give the user a plurality of predetermined light head orientations to select from. In other embodiments, the indent 102 may be a protrusion, bump, or the like that is formed generally opposite of the indent 102 but that functions in a similar way to resist relative pivoting between the handle 18 and the light head 22. In other embodiments, the flashlight 10 includes a continuous amount of indents 102 separated by very small increments.

The opening 76 in the light head 22 allows, as illustrated in FIGS. 3-9, pivoting of the light head 22 relative to the handle 18 without over-bending the wiring 72. Rather, the opening 76 provides space around the stems 80 for the wiring 72 to travel into the cylindrical portion 76*a*, sit in the slit portion 76*b*, and ultimately connect to/communicate with the first light source 27 and the second light source 28.

Figure 12:
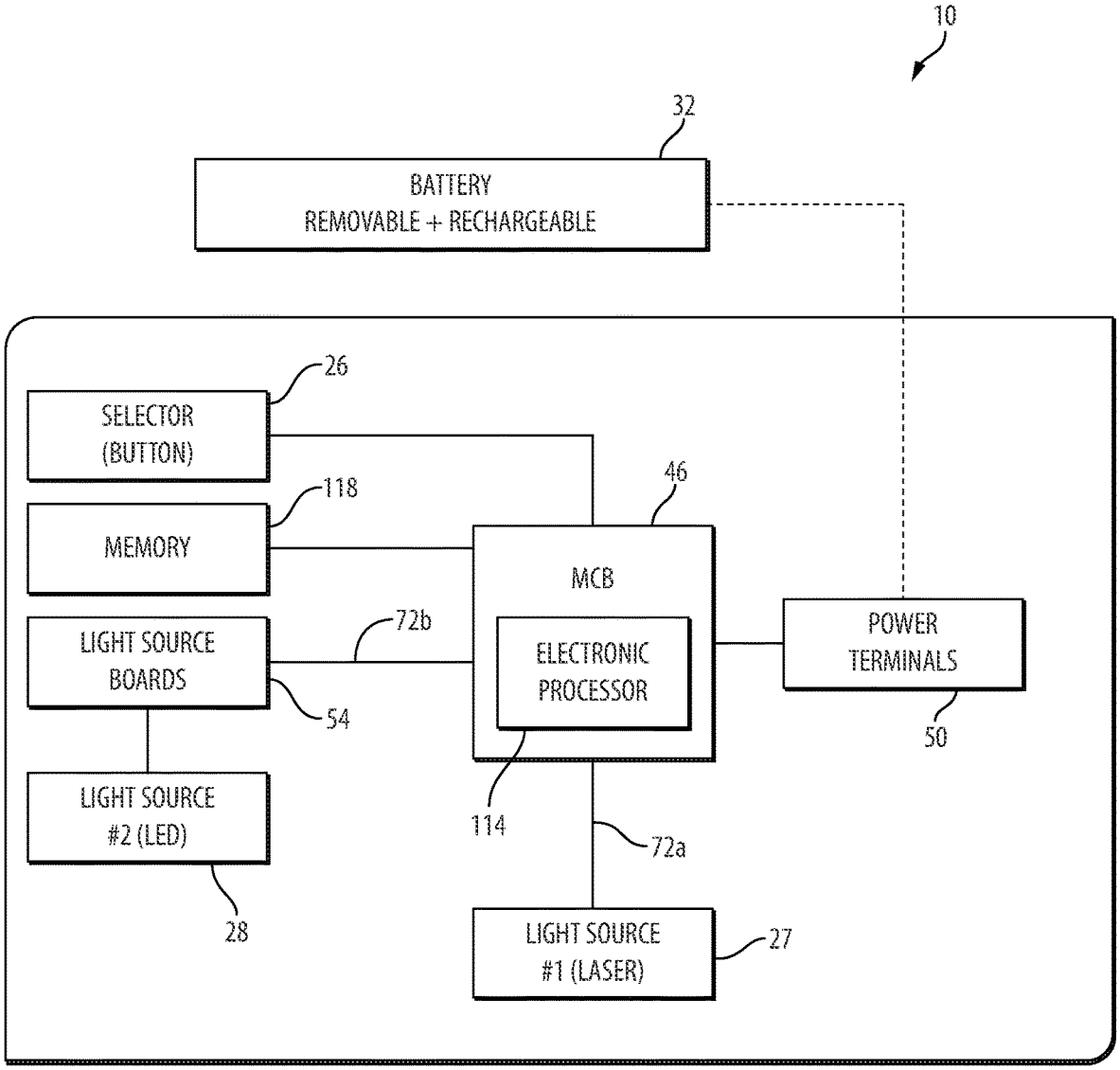
FIG. 12 is a block diagram of the flashlight of FIG. 1, according to an example embodiment.

FIG. 12 is an example block diagram of the flashlight 10, which includes an electronic processor 114 that may be supported by the MCB 46, in one embodiment. The electronic processor 114 is configured to implement several control circuits such as a main control circuit, a charging circuit, a light source enabling circuit, and the like. In the illustrated embodiment, the electronic processor 114 is electrically coupled to a variety of components of the flashlight 10 (e.g., the user interface 26, the MCB 46, etc.) and includes electrical and electronic components that provide power, operational control, and protection to the components of the flashlight 10. In some embodiments, the electronic processor 114 includes, among other things, a processing unit (e.g., a microprocessor, a microcontroller, or another suitable programmable device).

The processing unit of the electronic processor 114 may include, among other things, a control unit, an arithmetic logic unit ("ALU"), and registers. In some embodiments, the electronic processor 114 may be implemented as a programmable microprocessor, an application specific integrated circuit ("ASIC"), one or more field programmable gate arrays ("FPGA"), a group of processing components, or with other suitable electronic processing components.

In the illustrated embodiment, the electronic processor 114 includes a memory 118 (for example, a non-transitory, computer-readable medium) that includes one or more devices (for example, RAM, ROM, flash memory, hard disk storage, etc.) for storing data and/or computer code for completing or facilitating the various processes, layers, and modules described herein. The memory 118 may include database components, object code components, script components, or other types of code and information for supporting the various activities and information structures described in the present application. The electronic processor 114 is configured to retrieve data from the memory 118 and execute, among other things, instructions related to the control processes, algorithms, and methods described herein. The electronic processor 114 is also configured to store/write information on/to the memory 118. For example, the memory 118 can store information regarding the last used mode of the flashlight 10 before the flashlight 10 is turned OFF.

The battery 32, in one example, is always wired to provide power to the MCB 46 such that even if the flashlight 10 is not being used (e.g., turned OFF), the MCB 46 may still receive power from the battery 32. In similar embodiments, components such as the user interface 26 and the memory 118 receive power from the battery 32 through the MCB 46 and are not independently connected to the battery 32. In other embodiments, the battery 32 may be connected to each component in the flashlight 10 or to only some of the components in the flashlight 10.

Figure 13:
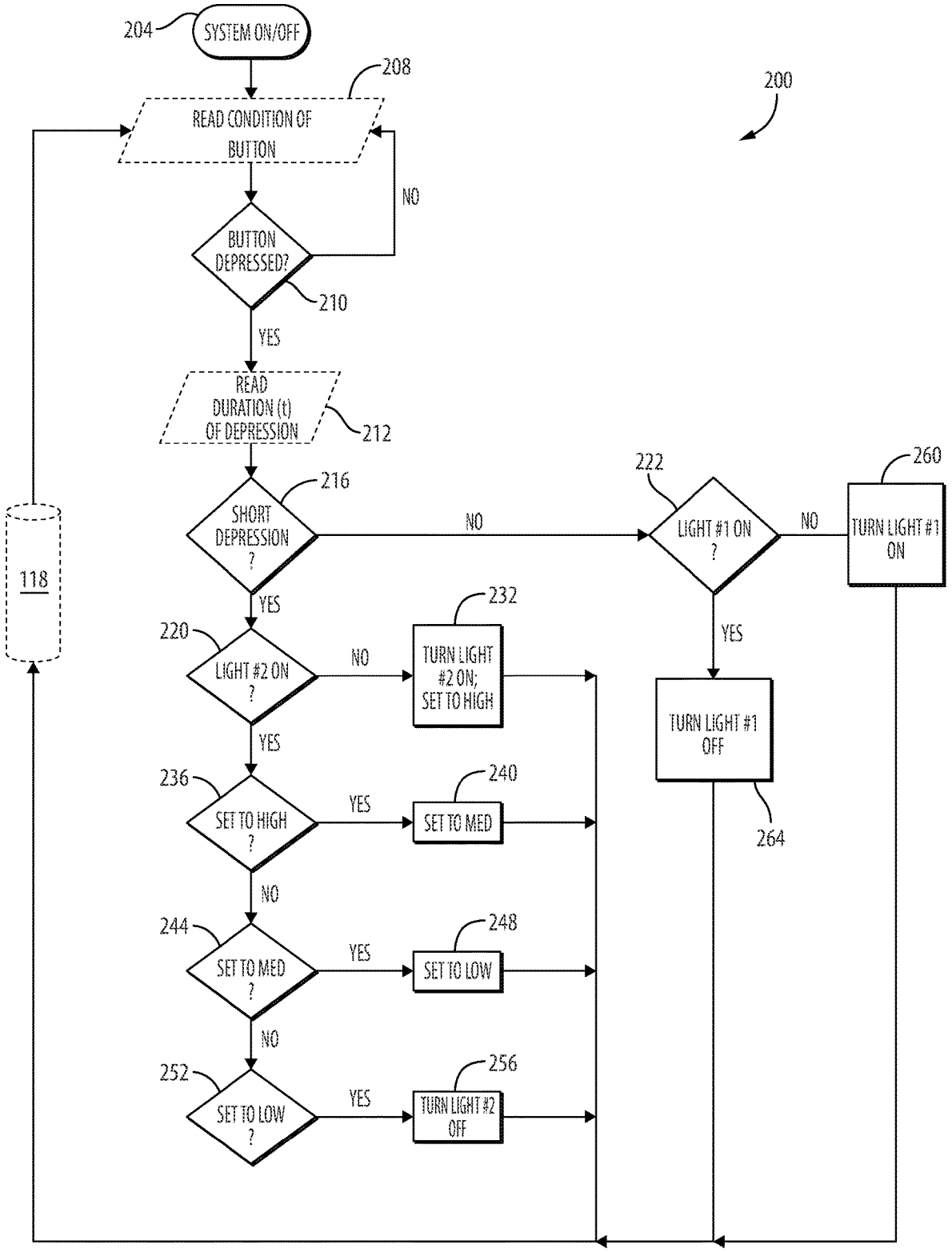
FIG. 13 is a flow chart of the flashlight of FIG. 1, illustrating a process for selecting a desired operating or output mode, according to an example embodiment.

With reference to FIGS. 12 and 13, the electronic processor 114 is configured to control a drive current provided by the battery 32 to the first light source 27, the second light source 28, and the MCB 46 by controlling a pulse width modulation ("PWM") duty cycle that controls when the battery 32 provides the drive current to the light board 54 and first light source 27. The light board 54 is configured to enable the second light source 28 based on a PWM signal provided to the light board 54, and the first light source 27 is configured to be enabled directly by the MCB 46 or by an internal board. The electronic processor 114 is further configured to receive inputs from the user interface 26 and communicate a command or signal (e.g., PWM signal) based on the inputs. For example, the electronic processor 114 is configured to receive an input (e.g., input PWM signal) when the user interface 26 is actuated by a user.

In the illustrated embodiment, the user interface 26 includes a contact that receives power through the MCB 46 and is configured to provide a status of the user interface 26 back to the electronic processor 114, which receives a signal from the user interface 26 based on the status. The electronic processor 114, in turn, interprets the status and signal of the user interface 26 and sends a PWM signal in accordance with the flowchart showing the process 200 in FIG. 13. Stated another way, the electronic processor 114 sets an operational mode based on detected actuation of the user interface 26. In addition to detecting whether the user interface 26 has been actuated, the electronic processor 114 is also configured to sense a duration (e.g., time (t) measured in seconds) of actuation. As described in greater detail below, the operational mode of the flashlight 10 operable in response to the user interface 26 being actuated for different amounts of time.

The operational modes of the flashlight 10, include a first light source 27 OFF mode, a second light source 28 OFF mode, a first light source 27 ON mode, a second light source 28 high output luminescent ON mode ("HIGH mode"), a second light source 28 medium output luminescent ON mode ("MEDIUM mode"), and a second light source 28 low output luminescent ON mode ("LOW mode"). In other embodiments, the flashlight 10 may include fewer or more modes. Additionally or alternatively, the flashlight 10 may include different types of modes, such as a flashing mode. In the OFF modes, the first light source 27 and the second light source 28 do not emit light because no PWM signal is sent by the electronic processor 114. In these mode, the first light source 27 and the second light source 28 may still be electrically connected to the battery 32.

During operation of the flashlight 10, the expectation of the user is that each mode emits a brightness/light type suitable for a desired application or scenario. The multiple modes of the flashlight 10 allow the user to advantageously switch between outputs without requiring the user to switch flashlights. Stated another way, the flashlight 10 is configured to accomplish the functions of a variety of flashlights such that the user can rely on a single flashlight rather than needing multiple flashlights depending on the desired application (e.g., a first flashlight with high lumen output for area lighting, a second flashlight with medium lumen output for recreation, a separate laser pointer, etc.).

With specific reference to the flowchart of FIG. 13, an example process 200 for controlling the flashlight 10 will now be described in greater detail. The process 200, which is implemented by the electronic processor 114 in one example, may include additional steps or functions not specifically discussed herein (e.g., reading a state-of-charge to confirm the flashlight has sufficient power, reading a temperature to confirm to flashlight can be operated safely, etc.). In addition, not all the of steps of the process 200 need to be performed or need to be performed in the order presented.

At process block 204, the flashlight 10 is turned ON/OFF, such as by a user actuating the user interface 26. At process block 208, a condition of the user interface 26 (e.g., is the user interface 26 depressed/being pressed?) is determined. A condition, state, and previous operating mode may each be stored to the memory 118 and accessed by the electronic processor 114 simultaneously. The memory 118 may further store the code/data needed to implement the process 200. In some embodiment, the data is stored directly on the MCB 46.

At process block 210, the electronic processor 114 determines whether the user interface 26 is being actuated. If the user interface 26 is not being actuated, then the process 200 loops back to reading the conditions at block 208. If the user interface 26 is being actuated, the process 200 proceeds to block 212, where the electronic processor 114 reads a length of time that the user interface 26 is being actuated. The actuation duration is measured in seconds by the electronic processor 114.

In some embodiments, the user interface 26 is depressible for two different lengths to time (t) and is configured to provide a signal to the electronic processor 114 based on the different lengths of time (t). In one example, the user interface 26 may be actuated a first length of time to switch the second light source 28 between ON and OFF states. In the illustrated embodiment, the first length of time may less than 1 second. The first length of time may also be considered a momentary actuation or short depression that corresponds to a first signal. The user interface 26 may be actuated for the short depression to cycle the second light source 28 between ON, OFF, HIGH, MEDIUM, and LOW modes. The user interface 26 may be actuated a second length of time that is different than the first length of time to cycle the first light source 27 between ON and OFF states. In the illustrated embodiment, the second length of time is greater (e.g., longer) than the first length of time and may be 1 or more seconds (e.g., approximately 1 to 3 seconds). The second length of time may also be considered a long depression that corresponds to a second signal different than the first signal.

In the illustrated embodiment, once the time of actuation is determined in block 212, the process 200 proceeds to blocks 216, where the electronic processor 114 associates a command based on the duration or time of actuation. At process block 216, the electronic processor 114 determines the time of actuation by receiving a signal from the user interface 26. If the time of actuation is within the first duration/length of time (e.g., is less than 1 second), the process 200 proceeds to block 220, where the electronic processor 114 retrieves the state of the second light source 28. If the time of actuation is within the second duration/length of time (e.g., greater than 1 second), the process 200 proceeds to block 222, where the electronic processor 114 retrieves the state of the first light source 27.

After a short depression, if the state is OFF (i.e., the second light source 28 is OFF), then the electronic processor 114 turns the second light source 28 ON and sets the operating mode to the HIGH mode, as shown at block 232. In the illustrated embodiment, the HIGH mode is automatically set as the default operating mode such that the electronic processor 114 will set the second light source 28 to the HIGH mode regardless of previous operating mode. In other embodiments, the MEDIUM mode or LOW mode may alternatively be set as a default operating mode. If the state is ON (i.e., second light source 28 is ON), then the electronic processor 114 reads the current operating mode of the second light source 28 and cycles the second light source 28 to the next mode (i.e., HIGH, MEDIUM, or LOW) in the order of operating modes. For example, if the second light source 28 ON in the HIGH mode (block 236), the electronic processor 114 will switch the second light source 28 to the MEDIUM mode, as shown at block 240; if the second light source 28 ON in the MEDIUM mode (block 244), the electronic processor 114 will switch the second light source 28 to the LOW mode, as shown at block 248; and if the second light source 28 ON in the LOW mode (block 252), the electronic processor 114 will switch the second light source 28 OFF, as shown at block 256.

In the illustrated embodiment, the order of operating modes for the second light source 28 may be cycled through in a re-occurring order from HIGH to MEDIUM to LOW to OFF to HIGH to MEDIUM to LOW, etc. In other embodiments, the order of modes may be reversed. Although the example process 200 allows the electronic processor 114 to turn the second light source 28 ON when the time of actuation is less than 1 second (block 232), other processes for the flashlight 10 may allow the electronic processor 114 to turn the second light source 28 ON when the time of actuation is greater than 1 second.

Referring back to block 212, if the time of actuation read in block 216 is greater than the first length of time (e.g., greater than 1 second), the process 200 proceeds to block 222, in which the first light source 27 is be turned ON. After a long depression, if the state is OFF (i.e., the first light source 27 is OFF), then the electronic processor 114 turns the first light source 27 ON, as shown at block 260. After a long depression, if the state is ON (i.e., the first light source 27 is ON), then the electronic processor 114 turns the first light source 27 OFF, as shown at block 264. Once a mode is changed and/or read, the process 200 loops back to block 208 to continuously read the condition, state, and operating modes.

In some embodiments, the second length of time may have a maximum length. For example, if the time of actuation read in block 216 is greater than 3 seconds, the electronic processor 114 may consider the actuation to be an accidental depression and not change the state of the light sources 27, 28. Alternatively, the electronic processor 114 may turn both of the light sources 27, 28 OFF, regardless of the current state of either light source 27, 28.

In the illustrated embodiment, the user interface 26 includes a single actuatable member, such as a single push-button or switch, that allows the user to step through the process 200. In other embodiments, the user interface 26 may include separate actuatable members that are independently operable to control the first light source 27 and the second light source 28. In still other embodiments, the user interface 26 may include a single actuatable member to turn the light sources 27, 28 ON and OFF as described above, but may include a separate actuatable member (e.g., a mode actuator) to change the intensity of the second light source 28.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described. Various features and advantages of the disclosure are set forth in the following claims.

What is claimed is:

1. A portable lighting apparatus comprising:

a handle;

a light head pivotally coupled to the handle through a plurality of positions via a joint;

a battery receptacle supported by the handle, the battery receptacle configured to receive a rechargeable battery;

a first light source supported in the light head, the first light source including a laser selectively operable to emit a single light wavelength;

a second light source supported in the light head, the second light source including one or more LEDs selectively operable to emit a distribution of light wavelengths;

a user interface supported by the handle and configured to be selectively actuated by a user to operate the first light source and the second light source; and an electronic processor in electrical communication with the first light source, the second light source, the battery receptacle, and the user interface, wherein the electronic processor is coupled to the first light source and the second light source via wiring that is routed through the joint, such that the electronic processor, the first light source, and the second light source are in electrical communication through each of the plurality of positions of the light head, wherein the handle further includes a channel formed in an outer surface of the handle, the channel including a through-hole extending from within the joint to the channel and an opening extending between the channel and an interior of the handle.

2. The portable lighting apparatus of claim 1, wherein the electronic processor is configured to:

receive a first signal from the user interface when the user interface is actuated for a first duration, operate the first light source in response to receiving the first signal, receive a second signal from the user interface when the user interface is actuated for a second duration that is different from the first duration, and operate the second light source in response to receiving the second signal.

3. The portable lighting apparatus of claim 2, wherein the first duration is longer than the second duration.

4. The portable lighting apparatus of claim 1, wherein the wiring is routed through the joint and into the through-hole, along the channel, and through the opening to the interior of the handle.

5. The portable lighting apparatus of claim 4, wherein the handle includes a cover positioned over the channel.

6. The portable lighting apparatus of claim 1, further comprising a detent positioned between the handle and the light head, the detent being biased into engagement with the handle or the light head to resist pivoting movement of the light head relative to the handle.

7. The portable lighting apparatus of claim 6, wherein the detent is positioned adjacent the joint.

8. A portable lighting apparatus comprising:

a first light source selectively operable to emit a first type of light;

a second light source selectively operable to emit a second type of light different from the first type of light, the first light source and the second light source operable to emit their respective types of light simultaneously with and independently of one another; and a user interface configured to be selectively actuated by a user to operate the first light source and the second light source, the user interface including a single actuatable member, wherein actuating the user interface for a first duration controls the first light source, wherein actuating the user interface for a second duration that is different than the first duration controls the second light source, and wherein actuating the user interface for the first duration is configured to cycle the first light source between ON and OFF states, and wherein actuating the user interface for the second duration is configured to cycle the second light source between ON, OFF, HIGH, MEDIUM, and LOW modes.

9. The portable lighting apparatus of claim 8, further comprising:

a handle including a first end and a second end;

a light head pivotally coupled to the handle adjacent the first end; and a battery receptacle supported by the handle adjacent the second end, the battery receptacle configured to receive a rechargeable battery, wherein the first light source and the second light source are supported in the light head.

10. The portable lighting apparatus of claim 9, wherein the first light source includes a laser.

11. The portable lighting apparatus of claim 10, wherein the second light source includes one or more LEDs.

12. The portable lighting apparatus of claim 11, wherein the first light source and the second light source are supported in the light head and oriented to emit their respective types of light in a common direction.

13. The portable lighting apparatus of claim 12, wherein the handle includes a magnet suitable to support the portable lighting assembly on a magnetic member.

14. The portable lighting apparatus of claim 8, further comprising an electronic processor configured to:

operate the first light source in response to receiving a first signal from the user interface when the user interface is actuated for the first duration, and operate the second light source in response to receiving a second signal from the user interface when the user interface is actuated for the second duration.

15. The portable lighting apparatus of claim 8, wherein the first duration is longer than the second duration.

16. The portable lighting apparatus of claim 15, wherein the first duration is 1 or more seconds and the second duration is less than 1 second.

* * * * *